US008146843B2

(12) United States Patent
Ye et al.

(10) Patent No.: US 8,146,843 B2
(45) Date of Patent: Apr. 3, 2012

(54) WASTE FOOD DISPOSAL UNIT

(75) Inventors: Yuan Jin Ye, Shenzhen (CN); Kwong Yip Poon, Hong Kong (CN); Yu Hong Guo, Shenzhen (CN); Chi Hwa Ho, Hong Kong (CN); Wai Hung Yip, Hong Kong (CN)

(73) Assignee: Johnson Electric S.A., La Chaux-de-Fonds (CH)

( * ) Notice: Subject to any disclaimer, the term of this patent is extended or adjusted under 35 U.S.C. 154(b) by 90 days.

(21) Appl. No.: 12/504,157

(22) Filed: Jul. 16, 2009

(65) Prior Publication Data

US 2010/0012757 A1 Jan. 21, 2010

(30) Foreign Application Priority Data

Jul. 17, 2008 (CN) ..... 2008 1 0141668

(51) Int. Cl.
*B02C 23/36* (2006.01)

(52) U.S. Cl. ..... 241/46.013

(58) Field of Classification Search ..... 241/46.013, 241/46.014, 46.015, 46.016, 46.017
See application file for complete search history.

(56) References Cited

U.S. PATENT DOCUMENTS

| | | | | |
|---|---|---|---|---|
| 2,476,630 | A | 7/1949 | Schindler | |
| 2,534,944 | A | 12/1950 | Bissey | |
| 2,824,702 | A | 2/1958 | Lee | |
| 2,857,109 | A | 10/1958 | Haeussler | |
| 2,932,459 | A | 4/1960 | Roe | |
| 4,128,210 | A * | 12/1978 | Brenner et al. | 241/46.014 |
| 4,134,555 | A * | 1/1979 | Rosselet | 241/46.013 |
| 5,129,590 | A * | 7/1992 | Shinya | 241/46.013 |
| 6,007,006 | A | 12/1999 | Engel et al. | |
| 6,439,487 | B1 * | 8/2002 | Anderson et al. | 241/46.013 |
| 6,481,652 | B2 * | 11/2002 | Strutz et al. | 241/46.013 |
| 7,337,996 | B2 * | 3/2008 | Hanson et al. | 241/46.013 |
| 7,500,628 | B2 | 3/2009 | Berger et al. | |
| 7,607,599 | B2 * | 10/2009 | Jara-Almonte et al. | 241/92 |
| 7,735,760 | B2 * | 6/2010 | Hanson et al. | 241/46.013 |
| 2006/0011758 | A1 | 1/2006 | Hanson et al. | |
| 2007/0075169 | A1 * | 4/2007 | Pan et al. | 241/46.013 |
| 2008/0265071 | A1 * | 10/2008 | Pan et al. | 241/46.013 |
| 2008/0296421 | A1 * | 12/2008 | Wu | 241/46.013 |
| 2008/0302891 | A1 * | 12/2008 | Anderson et al. | 241/46.014 |

FOREIGN PATENT DOCUMENTS

| | | |
|---|---|---|
| GB | 630494 | 10/1945 |
| GB | 765155 | 1/1957 |
| GB | 771419 | 4/1957 |
| GB | 920164 | 3/1963 |
| GB | 1040699 | 9/1966 |

* cited by examiner

*Primary Examiner* — David Walczak
*Assistant Examiner* — Jennifer C Chiang
(74) *Attorney, Agent, or Firm* — Muncy, Geissler, Olds & Lowe, PLLC

(57) ABSTRACT

A waste food disposer unit 10 for under sink application has a housing divided into a grinding chamber 12 and a motor chamber 15. The grinding chamber 12 has an inlet 16 for water and waste matter and an outlet 18 for water and shredded waste matter. A shredder ring 20 is disposed within the grinding chamber and has a plurality of cutting teeth 36 formed by slots 34 extending upwardly from a lower edge of the ring. A grinding disc 22 is disposed within the grinding chamber 12 and has a plurality of peripheral recesses 42 which co-acts with the cutting teeth 36 to shred the waste matter.

6 Claims, 4 Drawing Sheets

WASTE FOOD DISPOSAL UNIT

CROSS REFERENCE TO RELATED APPLICATIONS

This non-provisional patent application claims priority under 35 U.S.C. §119(a) from Patent Application No. 200810141668.2 filed in The People's Republic of China on Jul. 17, 2009.

FIELD OF THE INVENTION

This invention relates to a food waste disposal unit.

BACKGROUND

Food waste disposal units are used to reduce food scraps to small particles that can safely pass through the plumbing and sewage system. The food waste is masticated by being caught between teeth on a stationary shredder ring and a rotating grinding disc. Pushers attached to the grinding disc help to pulverize the waste and move it to the teeth of the shredder ring.

Waste food disposers, especially those designed for domestic use, are installed under the kitchen sink where they are directly attached to the drain of the sink.

The size of the particles of food waste passing out of the disposer is of concern as the larger the particles the more likely that the particles will cause a blockage in the plumbing. The size of the particles is known as the fineness. Speed and fineness are often a comprise as the finer the particle size often requires the waste to be ground or processed for a longer period. The larger the particle size, the faster the process can be completed.

Embodiments of the present invention allow a disposer with a finer particle size output while maintaining a high speed of processing the waste with a simple grinding structure by providing a plurality of cutouts or teeth in the peripheral edge of the grinding disc.

SUMMARY OF THE INVENTION

Accordingly, the present invention provides a waste food disposer comprising: a housing defining a grinding chamber having an inlet and an outlet; and a grinding mechanism disposed within the housing. The grinding mechanism includes a shredder ring, a grinding disc, and a motor configured for rotating the grinding disc relative to the shredder ring. The shredder ring has a plurality of slots and teeth formed between adjacent slots. The grinding disc has teeth formed by a plurality of peripheral recesses spaced about a radially outer periphery of the grinding disc. In operation, the teeth formed by the recesses of the grinding disc cooperate with the teeth of the shredder ring to tear waste matter being caught between the slots and the recesses.

Preferably, the grinding disc extends radially beyond an inner surface of the shredder ring.

Preferably, the grinding disc is axially spaced from the shedder ring by a small gap.

Preferably, the grinding disc is spaced from a wall of the grinding chamber by a gap, the gap being non-uniform.

Preferably, the grinding disc extends radially beyond an outer surface of the shredder ring, and a space is formed between the teeth of the shredder ring and an inner circumferential surface of the grinding chamber, the space facing and communicating with the slots of the shredder ring.

Preferably, the grinding disc is disposed within the shredder ring.

Preferably, the grinding disc is axially aligned with the teeth of the shredder ring.

Preferably, the recesses are uniformly spaced about the periphery of the grinding disc.

Preferably, the grinding disc is a single plate and supports a number of pushers.

Preferably, the slots and the teeth are uniform.

Preferably, the grinding disc is spaced from the shredder ring by a small gap, the gap being non-uniform.

Preferably, the housing defines a motor chamber separated from the grinding chamber by a divider and accommodating the motor therein.

Preferably, the motor is a high voltage DC motor.

BRIEF DESCRIPTION OF THE DRAWINGS

Preferred embodiments of the invention will now be described, by way of example only, with reference to the accompanying drawings. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
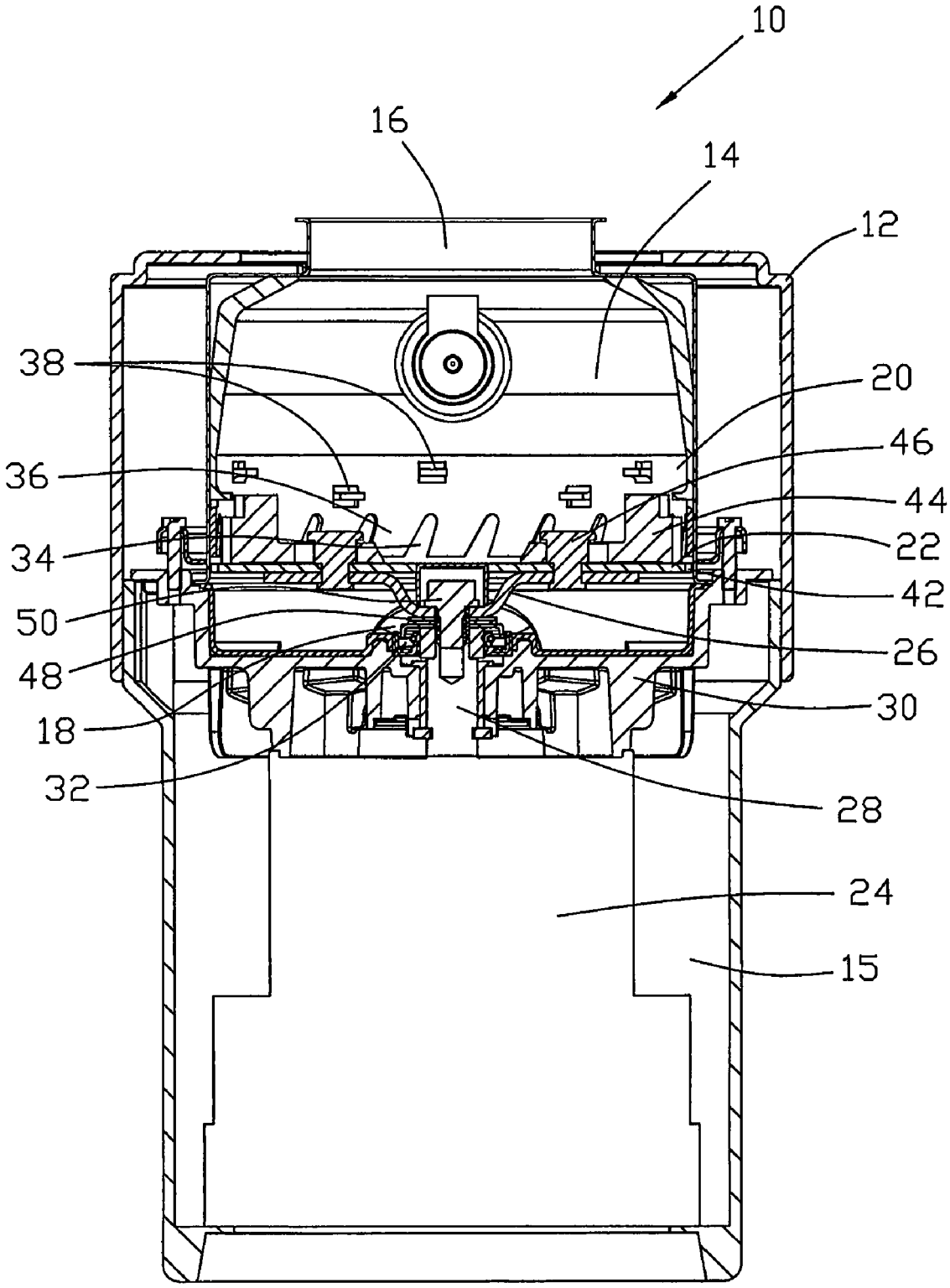
FIG. 1 is a sectional schematic view of a waste food disposer according to a first embodiment of the present invention.

The preferred waste food disposer, as shown in FIG. 1, has a housing 12 defining a grinding chamber 14, having an inlet 16 and an outlet 18. The inlet 16 is adapted to be fixed to the drain of a sink and the outlet is connected, in use, to a drain pipe for the removal of the waste. Located within the grinding chamber 14 is a grinding mechanism including a shredder ring 20 and a grinding disc 22.

The grinding disc 22 is mounted on an output shaft 28 of an electric motor 24 by way of a mounting bracket 26. The motor 24, in this embodiment, is a high voltage DC motor, and is located in a motor compartment 15 of the housing which is separated from the grinding chamber by a divider 30. The output shaft 28 of the motor 24 passes through the divider 30. A seal assembly 32 provides a waterproof rotating connection between the divider 30 and the shaft 28. The divider 30 has an outer periphery which forms part of the housing 12 and the outlet 18.

Figure 2:
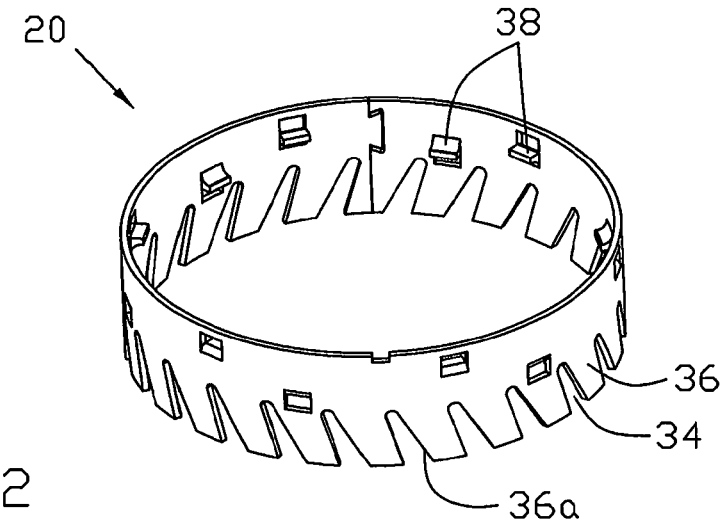
FIG. 2 is a perspective view of a shredder ring of the waster food disposer of FIG. 1.

The shredder ring 20 is fixed to the housing 12 within the grinding chamber 14. As shown in FIG. 2, the shredder ring 20 is a ring of hard material such as steel, preferably stainless steel and has a plurality of slots 34 extending upwardly from the lower edge of the ring forming large teeth 36. Optionally, the slots 34 are not vertical but are slanted at an angle between 20° and 30° to the vertical so as to point the teeth 36 downwardly in the direction of rotation of the grinding disc 22. Preferably, the slots 34 and thus the teeth 36 are tapered so as to be self-cleaning. The shredder ring 20 has a number of fingers 38 which project inwardly. Fingers 38 help with the grinding process.

Figure 3:
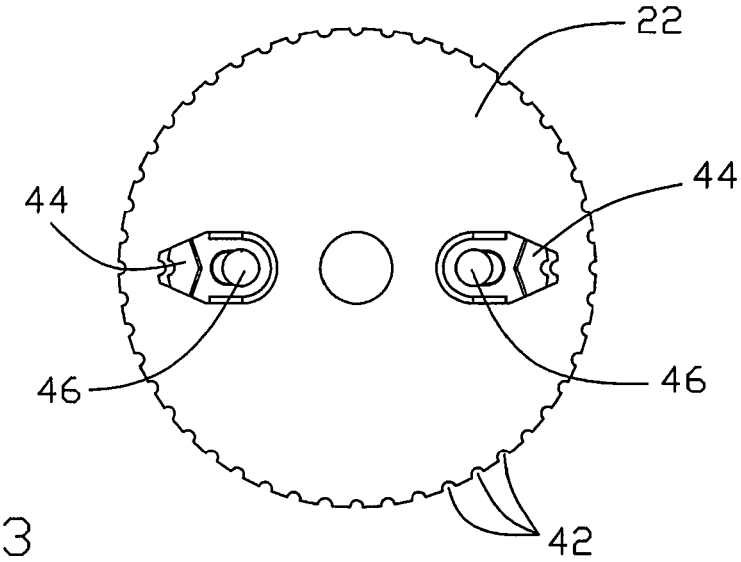
FIG. 3 is a plan view of the grinding disc of the disposer of FIG. 1.

The grinding disc 22 is more clearly shown in FIG. 3. The grinding disc 22 has a plurality of peripheral recesses 42 which form teeth for aiding the shredding process. The grinding disc 22 also has a number of pushers 44, two shown in this embodiment. The pushers 44 are fixed to the grinding disc 22 and stand vertically and close to the periphery of the grinding disc 22 to help push the matter to be shredded to the slots 34 in the shredder ring 20. The pushers 44 shown in FIG. 3 are swivel pushers 44 meaning that although they are attached to the grinding disc 22 they can rotate about and/or slide along the rivets 46. Each pusher 44 is attached to the grinding disc 22 by one rivet 46. Preferably, the grinding disc 22 is a single plate disc.

The mounting bracket 26 is fixed to the grinding disc 22 by rivets, ideally the same rivets 46 used to attach the pushers 44. The mounting bracket 26 is a stepped bar as shown in FIG. 1 with a non-round hole in the center which mates with and is keyed to the output shaft 28 of the motor 24. In this embodiment, the output shaft 28 has two flat sides. A spacer 48 and a screw 50 fix the mounting bracket 26 to the output shaft 28 in known manner. The ends of the mounting bracket 26 extend up from the central region and are then bent back to follow the surface of the grinding disc 22.

Figure 4:
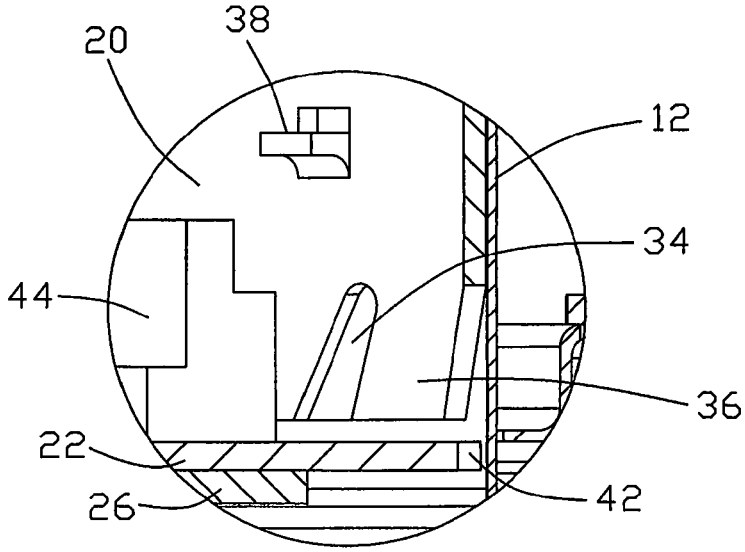
FIG. 4 is an enlarged view of an encircled portion IV of FIG. 1.

The mounting bracket 26 locates the grinding disc 22 axially below the shredder ring 20 and the grinding disc 22 has a radial extent greater that the inner radial dimension of the shredder ring 20, which is clearly shown in FIG. 4. Thus the peripheral recesses 42 of the grinding disc 22 are located directly below the teeth 36 of the shredder ring 20.

Referring back to FIG. 1, operation of the waste food disposer will now be described. Water and waste food is led into the grinding chamber 14 via the inlet 16. The water flows through the slots 34 in the shredder ring 20 and through the recesses 42 in the grinding disc 22 to be discharged from the housing 12 via the outlet 18. When the motor 24 is switched on, the output shaft 28 rotates the grinding disc 22 at high speed to fling the matter towards the shredder ring 20 and through the slots 34. Small particles of matter will pass through the slots 34 while large particles of matter will be caught between the teeth 36 of the shredder ring 20 and the recesses 42 on the disc, and torn until the particles are small enough to pass through the slots 34 or the recesses 42. Matter passing through the slots 34 is further cut into smaller pieces as it passes though the recesses 42 in the edge of the grinding disc 22. The recesses 42 act as rotating shears to cut the waste particles as they are washed through the slots 34. The pushers 44 help to fling the matter to the shredder ring 20 and into the slots 34. The fingers 38 do some minor shredding of softer matter but are used to stop large particles of matter from riding on the grinding disc and rubbing high on the shredder ring and thus, avoiding being caught by the teeth 36 of the shredder ring.

Seal assembly 32 prevents water and other liquids from passing through the shaft opening in the divider 30 and into the motor chamber 15.

Figure 5:
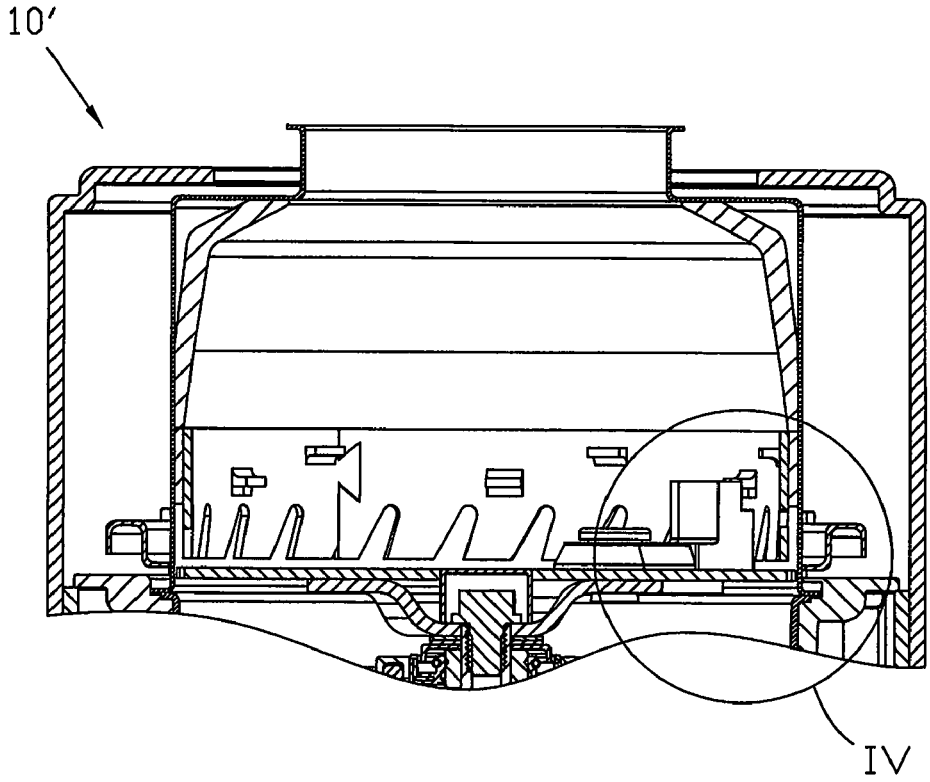
FIG. 5 is a sectional schematic view of a waste food disposer according to a second embodiment, one part of the waste food disposer cut away.
Figure 6:
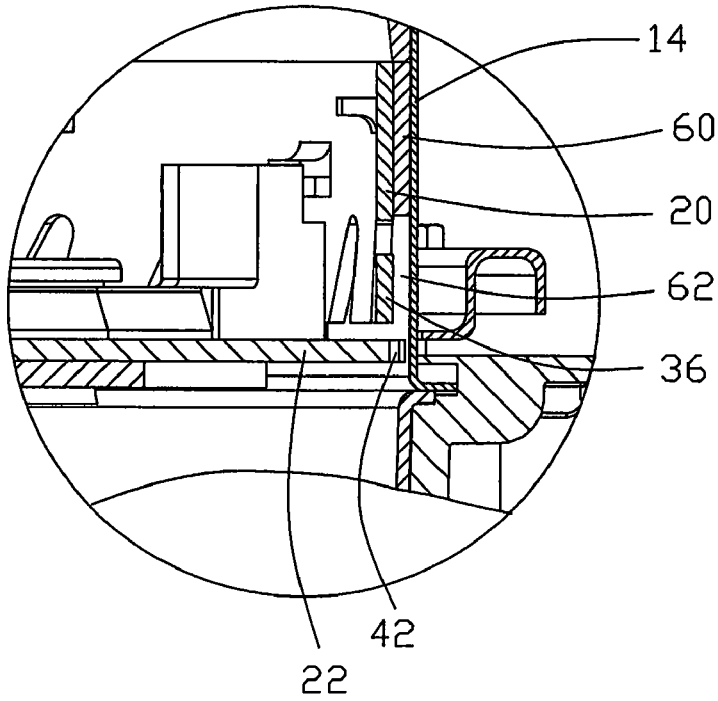
FIG. 6 is an enlarged view of an encircled portion VI of FIG. 5.

FIGS. 5 and 6 illustrate a waste food disposer 10' in accordance with a second embodiment. In the waste food disposer 10', an intermediate 60 is sandwiched between the outer circumferential surface of the grinding ring 20 and the inner circumferential surface of the grinding chamber 14. Thus, a space 62 is formed below the intermediate 60, facing the slots 34 of the grinding ring 20. The outer periphery of the grinding disc 22 radially extend beyond the shredder ring 20 such that the recesses 42 are axially located below the space 62. In operation, the waste matter may be shredded by being caught between the teeth 36, the space 62 and the recesses 42 until small enough to pass through the recesses 42 or the gap between the outer periphery of the grinding disc 22 and the inner circumferential surface of the grinding chamber 14.

In the above waste food disposers 10,10', the fineness of the ground waste is controlled by the size of the recess 42 of the grinding disc 22 and the gap between the outer periphery of the grinding disc 22 and the inner circumferential surface of the grinding chamber 14.

Figure 7:
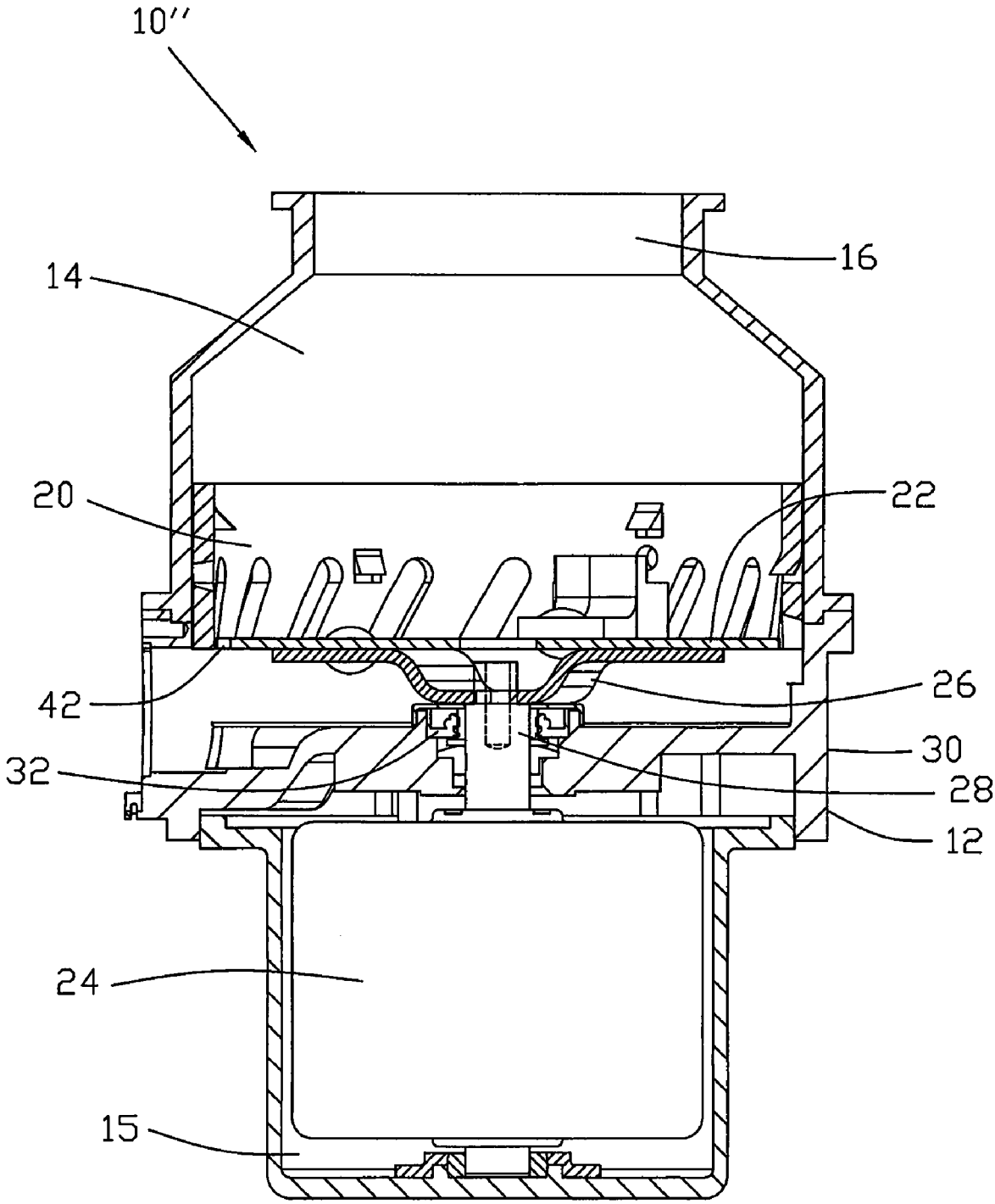
FIG. 7 is a sectional schematic view of a waste food disposer according to a third embodiment of the present invention.

FIG. 7 illustrates a waste food disposer 10" in accordance with a third embodiment. In waste food disposer 10", the grinding disc 22 is disposed within the shredder ring 20, axially aligned with the slots 34 and teeth 36. In this embodiment, the waste matter may be shredded by being caught between the teeth 36 and the recesses 42 until small enough to pass through the recesses 42 or the slots 34. The size of the slots will affect the size of the shredded particles and thus the size of the slots may be smaller than the slots in other embodiments, depending on the fineness requirements.

Waste food disposal units made according to the present invention exhibit a fast grinding process with a fine or small particle size which may be required by some sewage systems to avoid clogging and/or to comply with local regulations.

Although the invention has been described with reference to a preferred embodiment, it should be appreciated by those in the art that various modifications are possible within the scope of the invention. Therefore, the scope of the invention is to be determined by reference to the claims that follow.

For example, the shredder ring itself may be stepped and the pushers either fixed type, swivel type or a combination of both types, are correspondingly stepped to match the grinding interface and push the waste matter out to slots in the shredder plate.

Although the teeth and slots are shown being of uniform shape, the width of the teeth and/or the width of the slots may vary and the location of the peripheral recesses on the grinding disc may not be evenly spaced. It is thought that this may produce a quieter operation when the disposer is operating under no load by reducing beat frequencies or whistling.

Similarly, the gap between the teeth on the grinding ring and grinding disc can vary. Varying the gap may help reduce beat frequencies.

The distance between the grinding disc and the grinding chamber can vary. This may increase the efficiency of the disposer by providing a slicing effect on the material being disposed.

Several layers of material can be added between the grinding ring and the grinding chamber to reduce noise.

In the claims which follow and in the preceding description of the invention, except where the context requires otherwise due to express language or necessary implication, the verbs "comprise" "include" and "have", and conjugates thereof, are used in an inclusive sense, i.e. to specify the presence of the stated features but not to preclude the presence or addition of further features in various embodiments of the invention.

The invention claimed is:

1. A waste food disposer, comprising:

a housing defining a grinding chamber having an inlet and an outlet; and a grinding mechanism disposed within the housing including:

a shredder ring with a plurality of slots and teeth formed between adjacent slots;

a grinding disc, disposed coaxially with the shredder ring and axially spaced from the shredder ring by a small gap;

a motor for rotating the grinding disc relative to the shredder ring;

wherein the grinding disc is a single plate with uniform depth and supports a number of pushers thereon;

wherein the grinding disc extends radially beyond an inner surface of the shredder ring;

wherein the grinding disc is spaced from a wall of the grinding chamber by a radial gap, the radial gap being non-uniform; and wherein the grinding disc has teeth formed by a plurality of peripheral recesses spaced about a radially outer periphery of the grinding disc, and in operation the teeth formed by the recesses of the grinding disc cooperate with the teeth of the shredder ring to tear waste matter being caught between the slots and the recesses.

2. The waste food disposer of claim 1, wherein the grinding disc extends radially beyond an outer surface of the shredder ring, and a space is formed between the teeth of the shredder ring and an inner circumferential surface of the grinding chamber, the space facing and communicating with the slots of the shredder ring.

3. The waste food disposer of claim 1, wherein the recesses are uniformly spaced about the periphery of the grinding disc.

4. The waste food disposer of claim 1, wherein the slots and the teeth are uniform.

5. The waste food disposer of claim 1, wherein the housing defines a motor chamber separated from the grinding chamber by a divider, the motor being accommodated within the motor chamber.

6. The waste food disposer of claim 5, wherein the motor is a high voltage DC motor.

* * * * *